US009303898B2

(12) United States Patent
Sulzer

(10) Patent No.: US 9,303,898 B2
(45) Date of Patent: Apr. 5, 2016

(54) PORTABLE TEMPERATURE-CONTROLLED WATER HEATER

(76) Inventor: Christopher James Sulzer, St Louis Park, MN (US)

( * ) Notice: Subject to any disclaimer, the term of this patent is extended or adjusted under 35 U.S.C. 154(b) by 1522 days.

(21) Appl. No.: 12/960,542

(22) Filed: Dec. 5, 2010

(65) Prior Publication Data

US 2011/0132349 A1 Jun. 9, 2011

Related U.S. Application Data

(60) Provisional application No. 61/267,080, filed on Dec. 6, 2009.

(51) Int. Cl.

| | |
|---|---|
| ***F24B 9/00*** | (2006.01) |
| ***F24C 13/00*** | (2006.01) |
| ***F24H 1/00*** | (2006.01) |
| ***F24H 7/02*** | (2006.01) |
| ***F24H 7/04*** | (2006.01) |
| ***F24H 9/20*** | (2006.01) |
| ***F24H 1/16*** | (2006.01) |
| ***F24H 1/06*** | (2006.01) |

(52) U.S. Cl.

CPC ..... *F24H 9/2028* (2013.01); *F24H 1/06* (2013.01); *F24H 1/16* (2013.01); *F24H 1/167* (2013.01)

(58) Field of Classification Search

CPC ..... F24H 1/06; F24H 1/16; F24H 1/167

USPC ..... 126/5, 344, 367.1; 392/441, 444

See application file for complete search history.

(56) References Cited

U.S. PATENT DOCUMENTS

| | | | | |
|---|---|---|---|---|
| 2,277,598 | A * | 3/1942 | McCollum | 237/2 A |
| 3,192,916 | A | 7/1965 | Vitkay | |
| 3,246,644 | A | 4/1966 | Peterson | |
| 3,431,565 | A | 3/1969 | Nelson | |
| 5,417,201 | A | 5/1995 | Thomas et al. | |
| 5,460,161 | A | 10/1995 | Englehart et al. | |
| 5,524,820 | A | 6/1996 | Regan | |
| 5,937,768 | A | 8/1999 | Atwood | |
| 6,430,760 | B2 | 8/2002 | Johns | |
| 6,628,894 | B2 * | 9/2003 | Winter et al. | 392/447 |
| 6,877,461 | B2 | 4/2005 | Long et al. | |
| 6,929,190 | B1 | 8/2005 | Adrian | |
| 6,978,496 | B2 | 12/2005 | Adrian | |
| 2007/0051007 | A1 * | 3/2007 | Reets et al. | 34/86 |

FOREIGN PATENT DOCUMENTS

| | | | | |
|---|---|---|---|---|
| GB | 191100574 | A * | 0/1912 | F24H 1/06 |
| GB | 191319547 | A * | 0/1914 | F24H 1/06 |

OTHER PUBLICATIONS

Manufacturer: Zodi Outback Gear Feb. 19, 2009 Product: Fire Coil #7002 —http://www.zodi.com/Dealer/zodidealermedia7002.html 6980 South 400 West Midvale UT 84047.

* cited by examiner

*Primary Examiner* — William G Corboy

(57) ABSTRACT

An apparatus and method for portably heating water for the purpose of showering or cleanup. A flow of water, originating from a supply container, is warmed as it passes through a heat exchanger transferring energy from a heat source. The heated flow of water is deposited into an accumulating container. The water temperature is actively and automatically controlled by a temperature-responsive valve. Responding to the temperature of the flowing water, the temperature-responsive valve varies the flow of water so as to produce an accurate water temperature within the accumulating container. The flow of water is gravitationally motivated by a pressure head differential between the supply container positioned at an upper elevation and the accumulating container positioned at a lower elevation.

6 Claims, 13 Drawing Sheets

PORTABLE TEMPERATURE-CONTROLLED WATER HEATER

CROSS-REFERENCE TO RELATED APPLICATIONS

This application is based on and claims the benefit of U.S. provisional patent application Ser. No. 61/267,080, filed Dec. 6, 2009 by the present inventor.

FEDERALLY SPONSORED RESEARCH

Not Applicable

SEQUENCE LISTING OR PROGRAM

Not Applicable

BACKGROUND

1. Field of the Invention

This invention generally relates to water heaters, and more specifically, a portable temperature-controlled water heater.

2. Prior Art

Outdoor sports enthusiasts many times enjoy aspects of nature requiring a separation from modern amenities such as running water, hot showers, and many of the conveniences that are typically encountered during day-to-day living. Though these accommodations may be desired, they are generally not practical to employ in the outdoors.

A very basic method of heating water with a kettle over a fire or camp stove, though simple, is relatively inefficient in producing water in quantities sufficient for showering. In addition, it is difficult to obtain a precise water temperature suitable for contact with skin.

U.S. Pat. No. 6,877,461 to Long et al. (2005) discloses a method for heating water by mechanically pumping water through a heat exchanger warmed by a burner assembly. This method requires the transportation of bulky equipment, a supply of batteries, and fuel weighing upwards of 12 kg (26.4 lbs) or more.

A thermosiphon water heating system disclosed in U.S. Pat. No. 5,417,201 to Thomas et al. (1995) relies on density changes that occur as water is heated within a heat exchanger. The change in water density motivates the circulation of water through the heat exchanger. A single container of water is gradually heated taking a considerable amount of time, upwards of an hour or more. The user must monitor the water temperature in the container and judge when the time is right to remove the heat exchanger from the heat source. In addition, due to the nature of the thermosiphoning principle, stratifications in water temperature prevail vertically within the water container. During operation, the water towards the top of the container is likely to be as much as +10 C (+20° F.) warmer than the water on the bottom making it difficult to determine average bulk water temperature.

Other portable water heaters such as those disclosed in U.S. Pat. No. 5,460,161 to Englehart et al. (1995) and U.S. Pat. No. 3,246,644 to Peterson (1966) heat water to the boiling point within a heat exchanger. Upon boiling, water expands into steam driving the flow of water through the system similar to an automatic coffee maker. Water and steam temperatures up to 100 C (212° F.) can pose additional handling risks for the user during normal operation. Also, from a thermodynamic perspective, it is less efficient to heat water to the boiling point only to have to dilute or cool the water down to approximately 38 C (100° F.), necessary for contact with the skin. Heat energy is spent during the phase change of water from a liquid to a gas.

SUMMARY

The present invention fills the previously mentioned deficiencies by providing a portable, temperature-controlled, water heating system which advantageously allows for a compact and lightweight design. Coupled with a variety of possible heat sources, the present invention is capable of quickly heating a volume of water to an accurate, user-selected temperature appropriate for contact with the skin. Energy is absorbed efficiently from a heat source such as a camp fire, backpacking stove, or burner assembly, warming the water to the temperature setting selected. In one embodiment, the dry system, including water containers, weighs less than 0.9 kg (2 pounds) and packs to a size of 180 mm (7 in.) in diameter×5 cm (2 in.) in height. For a typical example, the water heating system is capable of heating 15 liters (4 gallons) of water from 15 C (60° F.) to 38 C (100° F.) in approximately 12 minutes.

DRAWINGS

Figures

DETAILED DESCRIPTION

General—First Embodiment

Figure 1:
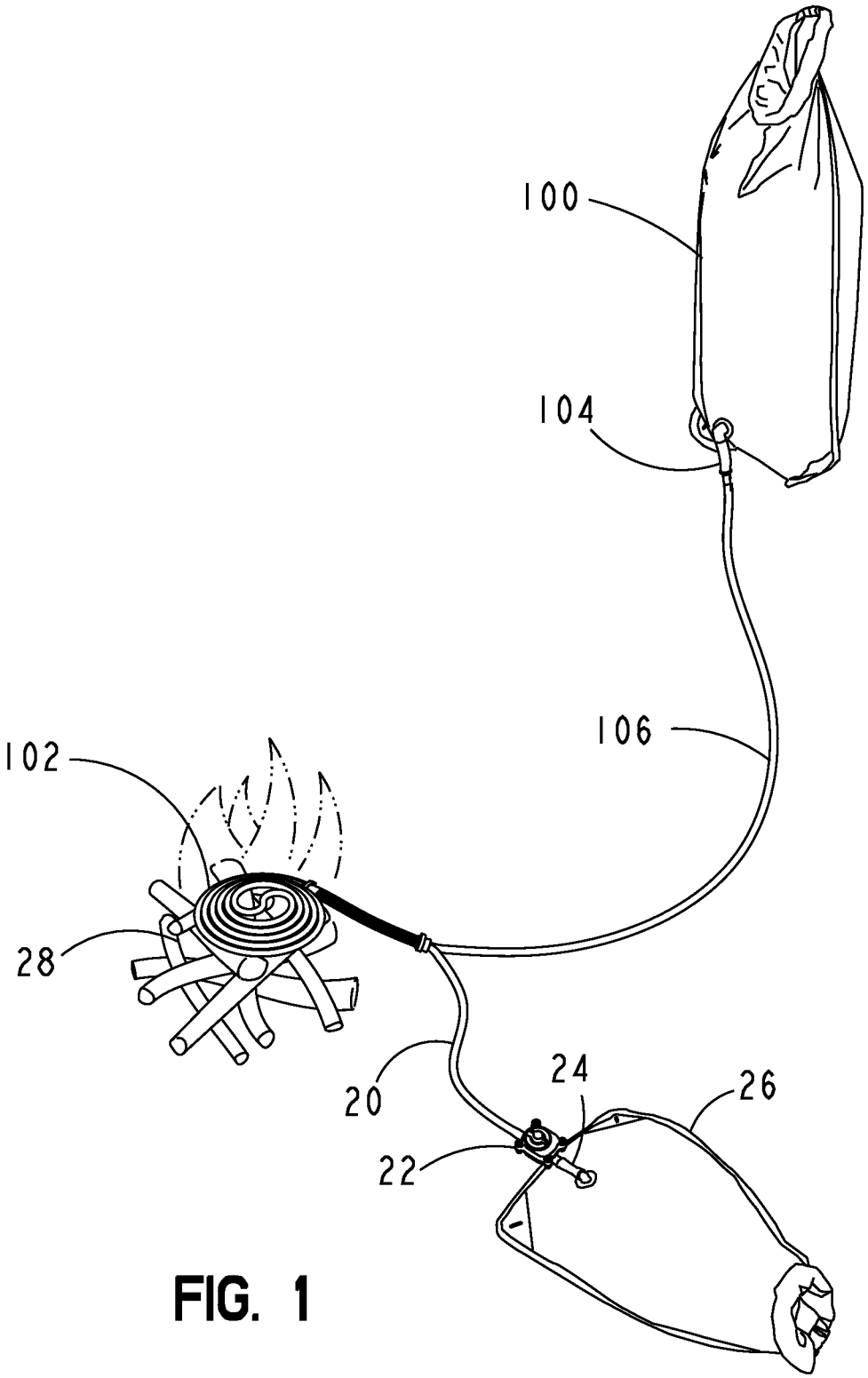
FIG. 1 is a perspective view of a portable water heater shown in accordance with the first embodiment.

Referring to FIG. 1, one embodiment of the portable water heater is shown in a typical state of use. An elevated supply container 100 is constructed of a flexible waterproof polymeric material ideally having one or more translucent sides. A translucent side allows a user to visually observe the water level within. Supply container 100 has a volume of approximately 8 to 20 liters which allows for a reasonable working quantity of water, at the same time limiting the filled weight to allow one person to lift and carry it. Many sizes of containers would be suitable, but presently I contemplate that a volume of 15 liters is a versatile working volume which can provide water for up to four people to use for showering. I contemplate that a flexible, sealed container which collapses upon emptying is preferred, however a rigid polymeric or metallic container would also be suitable, provided it has either an open or vented top to prevent a negative pressure from developing as water exits the container.

Supply container 100 has a drain port 104 which couples to a supply duct 106. Alternately, drain port 104 may be eliminated and supply duct 106 placed directly into an opening near the top of supply container 100, allowing for siphon feeding. Supply duct 106 is constructed from silicone tubing measuring 11.1 mm (7/16 in.) O.D.×7.9 mm (5/16 in.) I.D. and approximately 1.6 m (64 in.) in length. Although other flexible polymeric materials are suitable, presently I contemplate that silicone tubing is preferred due to its advantageous properties including high temperature resistance, flexibility and kink resistance. Also suitable, one or more segment of rigid metallic tubing may be substituted for a corresponding segment of flexible tubing. In addition, a filter means may be integrated into drain port 104 or added in-line in combination with duct 106.

A heat exchanger 102 connects to supply duct 106 and to a heated water duct 20. Heated water duct 20 is similar in cross section and material to supply duct 106, however its length is shorter, approximately 0.81 m (32 in.). Heat exchanger 102 resides over a heat source 28, which is shown as a wood fueled fire in this embodiment. A stove or burner assembly is also a suitable heat source.

Duct 20 connects to a temperature-responsive valve 22. Temperature-responsive valve 22 couples to an accumulating container 26 through a container port 24. Accumulating container 26 is preferably similar in construction to supply container 100 so that they could be used interchangeably, but it is not required that they are identical. Alternately, temperature-responsive valve 22 could deposit water directly into a rigid or flexible container with a closed or open top serving the same function as container 26. Presently I contemplate that it is preferred to use a flexible, sealed container for water accumulation in order to prevent excessive evaporative cooling of the heated water as well as allowing for a compact stored size. Optionally, accumulating container 26 may be enclosed in an additional covering made of an insulating material such as closed cell polyethylene foam so as to further slow heat loss.

Figure 2:
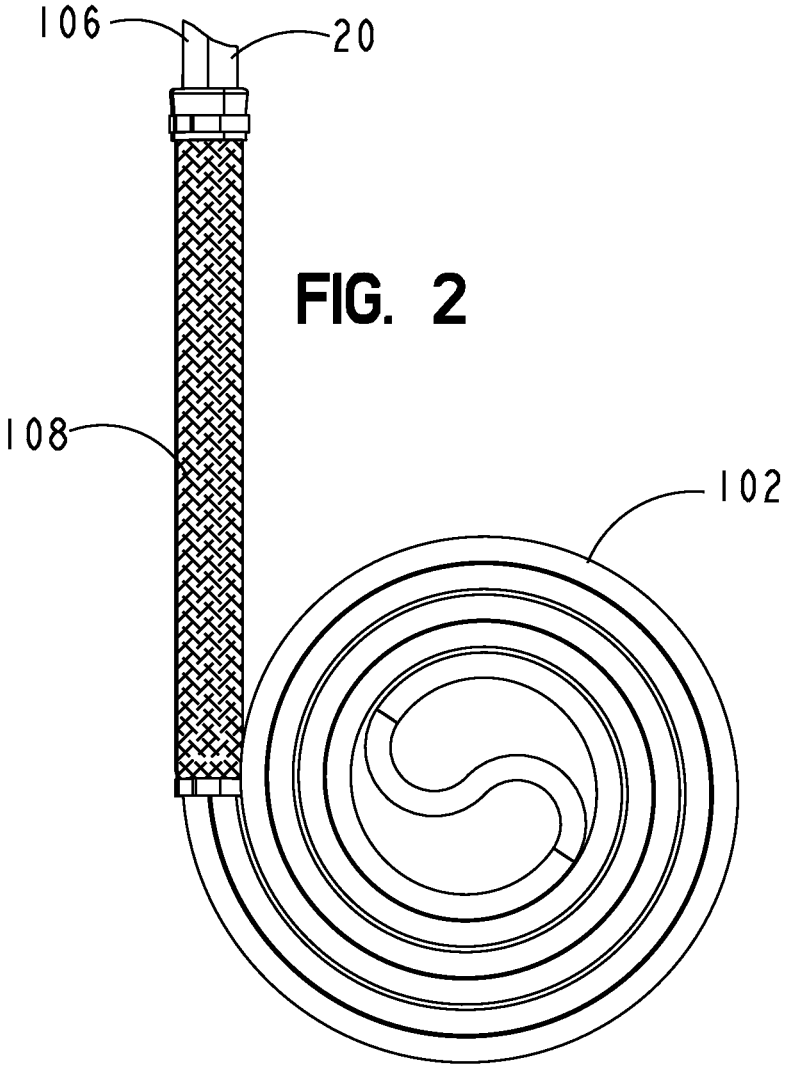
FIG. 2 is a top view of a heat exchanger shown in accordance with the first embodiment.
Figure 3:
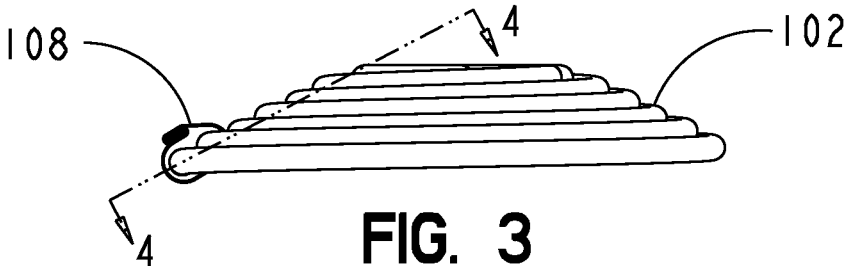
FIG. 3 is a front-side view of a heat exchanger shown in accordance with the first embodiment.
Figure 4:
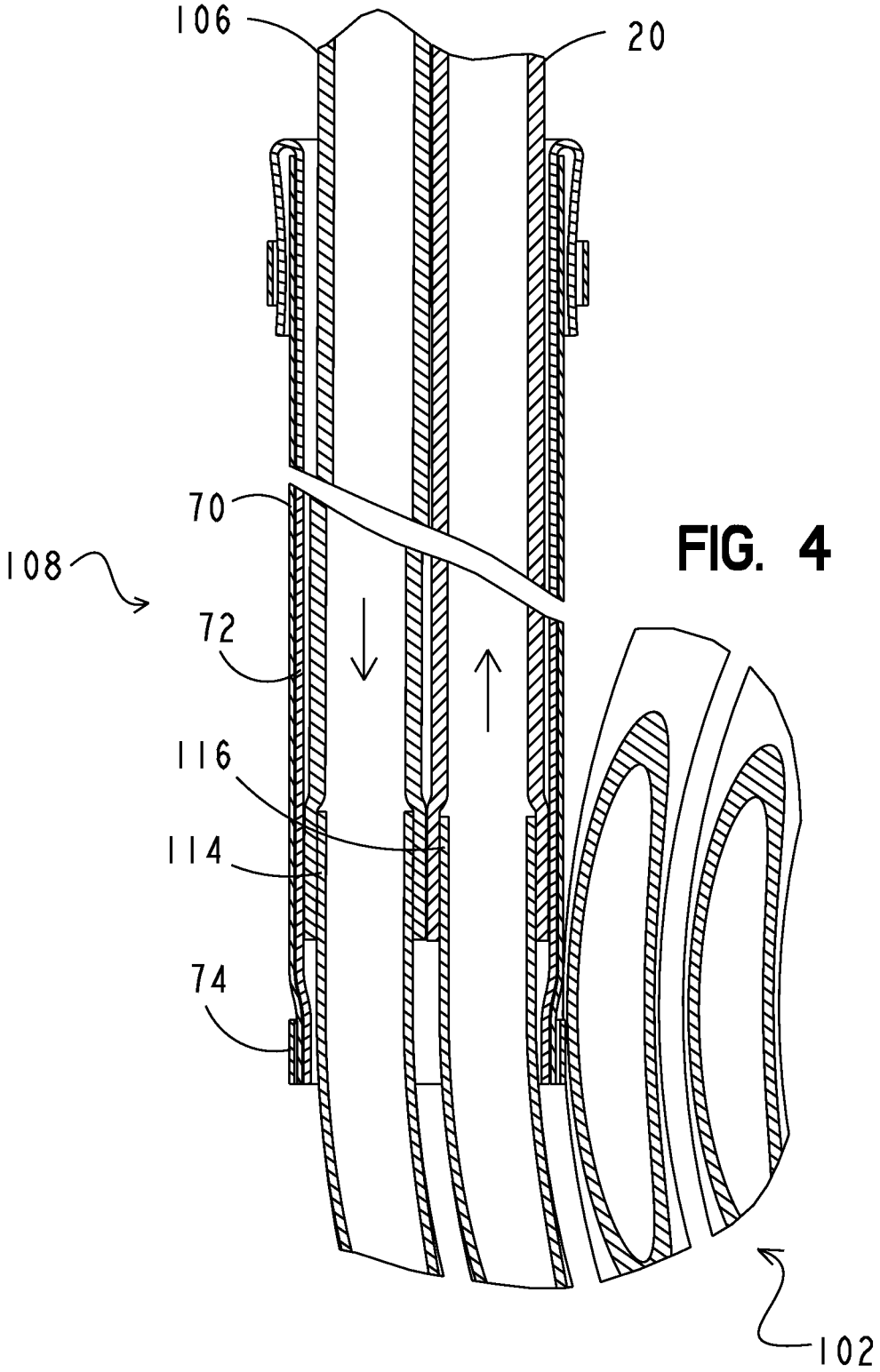
FIG. 4 is a section view along line 4-4 in FIG. 3 of a heat exchanger shown in accordance with the first embodiment.

Referring to FIGS. 2, 3, & 4 supply duct 106 connects to a heat exchanger inlet 114 by means of a friction fit. Duct 20 connects to a heat exchanger outlet 116 also by means of a friction fit.

Heat exchanger 102 is constructed of cylindrical aluminum tubing 9.5 mm (3/8 in.) O.D.×0.9 mm (0.035 in.) wall thickness with an uncoiled length of approximately 1.8 m (72 in.). Other thermally conductive materials such as copper or stainless steel are also suitable, although heavier and typically having a higher material cost. In this embodiment heat exchanger 102 is formed in such a manner to allow heat exchanger inlet 114 and a heat exchanger outlet 116 to be routed generally adjacent to each other with a formed overall outer diameter of approximately 180 mm (7 in.). Reversing inlet 114 and outlet 116 is also suitable. Referring to FIGS. 2-3, heat exchanger 102 is formed to have a height of approximately 38 mm (1.5 in.). Many other sizes, cross sections, and routings of tubes or vessels are suitable for constructing heat exchanger 102 but at the present time I contemplate the size and routing described above is advantageous in terms of compact storage which is described later.

A flexible duct insulator 108 surrounds a short length of both supply duct 106 and heated water duct 20. Duct insulator 108 is beneficial in this embodiment for the purpose of insulating ducts 106 and 20 from heat source 28 (FIG. 1). Flexible duct insulator 108 overlaps the connections made by duct 106 and inlet 114 as well as duct 20 and outlet 116. Duct insulator 108 extends and protects approximately 250 mm (10 in.) away from ports 114 and 116 of heat exchanger 102.

Duct Insulator—First Embodiment

Referring to FIG. 4, flexible duct insulator 108 is made up of a flexible and abrasion resistant duct sheath 70 and a flexible duct insulation sleeve 72. Duct sheath 70 is an approximately 300 mm (12 in.) length of braided sleeve made of stainless steel wire. Duct sheath 70 has a nominal inner diameter of 22 mm (0.88 in.) with a 0.25 mm (0.010 in.) braided wire wall thickness. Duct insulation sleeve 72 is made of one or more plies of braided, resin-coated, fiberglass sleeve with a wall thickness of 1.1 mm (0.046 in.) and capable of withstanding a minimum continuous working temperature of 650 C. Other temperature-resistant, thermally insulating materials such as ceramic blanket are also suitable. Duct insulator 108 is joined to heat exchanger 102 by means of a clamp 74. Clamp 74, made of stainless steel, compresses around the perimeter of duct insulator 108 pinching it against heat exchanger 102. Other methods of captivating duct insulator 108 to heat exchanger 102 such as a crimped stainless steel or brass ferrule are also suitable.

Temperature-Responsive Valve—First Embodiment

Figure 5:
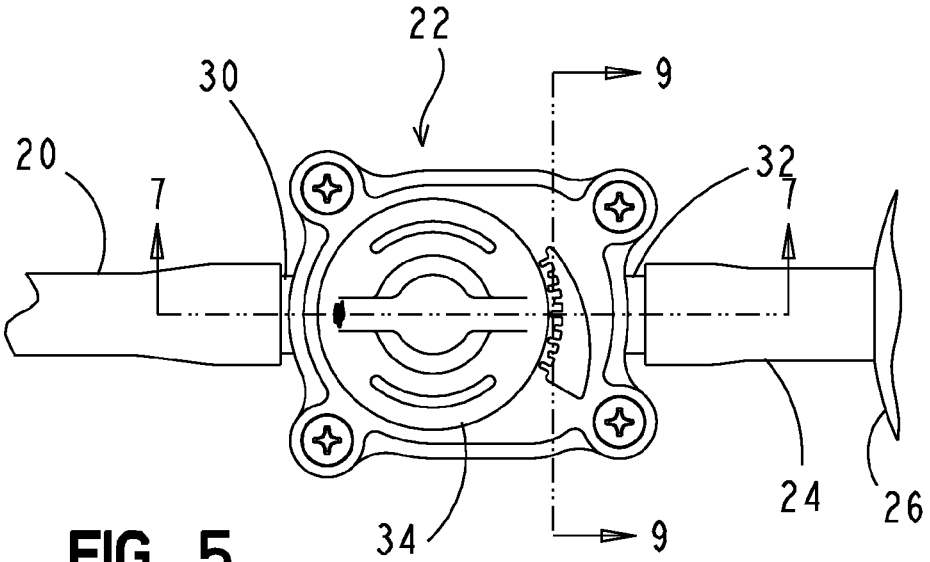
FIG. 5 is a top view of a temperature-responsive valve shown in accordance with at least one embodiment.
Figure 6:
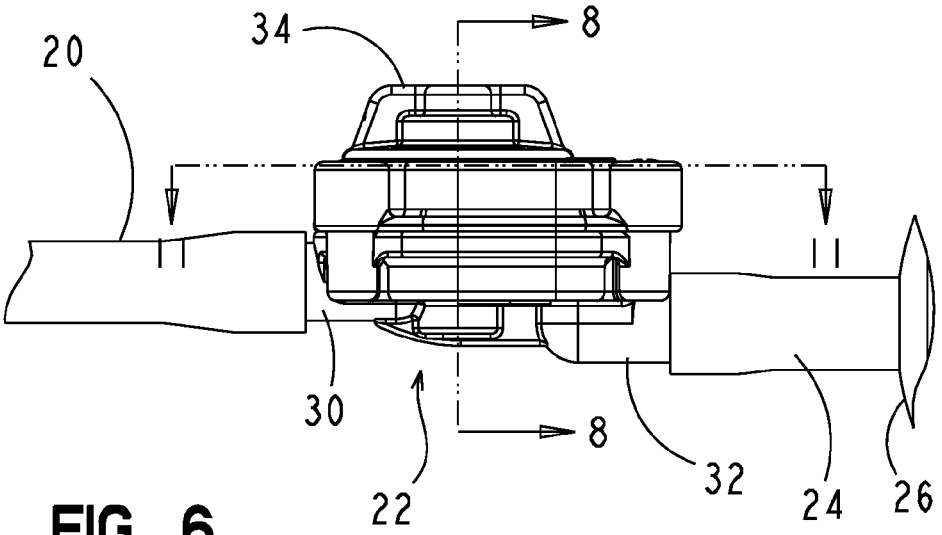
FIG. 6 is a front-side view of a temperature-responsive valve shown in accordance with at least one embodiment.

Referring to FIGS. 5 and 6, temperature-responsive valve 22 has an inlet 30, an outlet 32 and a temperature selector 34. Heated water duct 20 connects to inlet 30 by means of a friction fit. Outlet 32 couples to container 26 through container port 24. An additional length of tubing between outlet 32 and port 24 is also suitable, as is depositing directly into container 26 without the use of container port 24.

Figure 7:
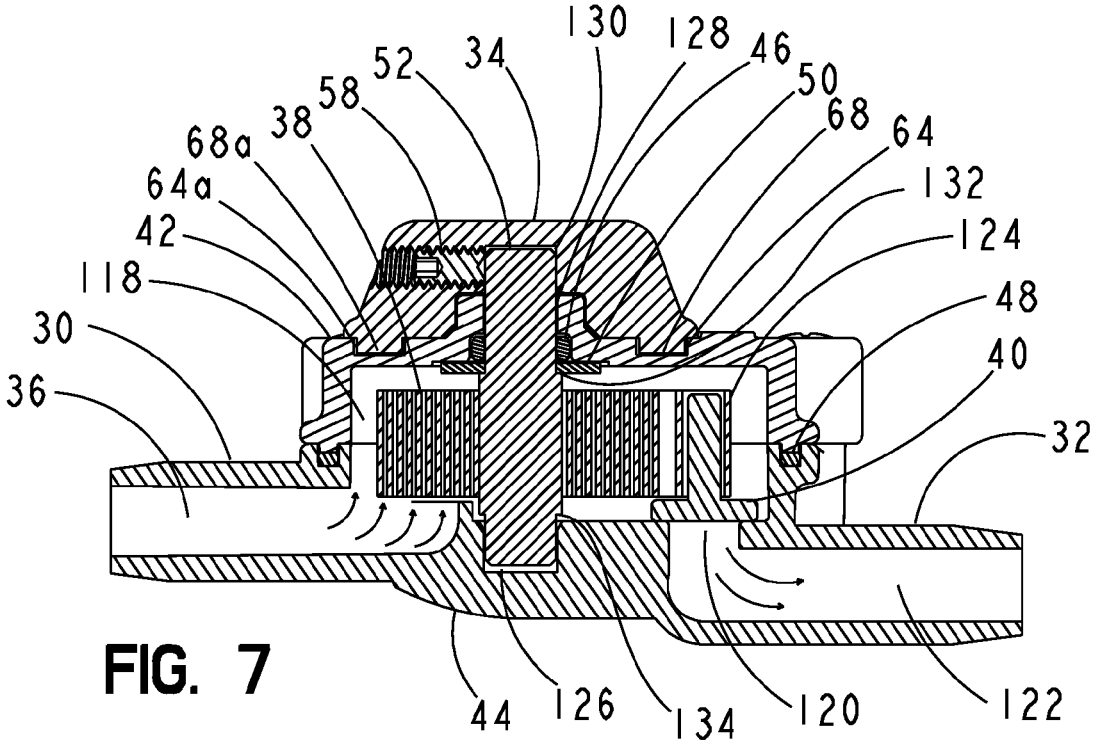
FIG. 7 is a section view of a temperature-responsive valve taken along line 7-7 in FIG. 5.
Figure 8:
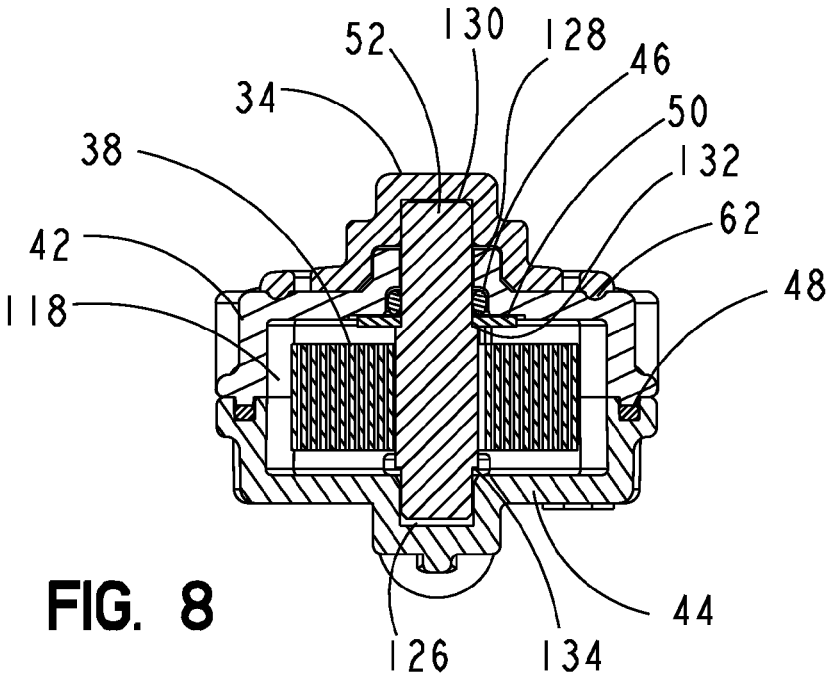
FIG. 8 is a section view of a temperature-responsive valve taken along line 8-8 in FIG. 6.

Referring to FIGS. 7 and 8, an inner lumen 36 of inlet 30 intersects a chamber 118. Chamber 118 is formed between an upper housing 42 and a lower housing 44. Upper and lower housings 42 and 44 are made of a rigid material such as polycarbonate, nylon, polypropylene, etc. Within chamber 118, a movable valve member 40 having a displacement, variably blocks a valve aperture 120 forming a variable restriction for the flow of water. Aperture 120 intersects with an inner lumen 122 of outlet 32. Aperture 120 has an I.D of approximately 6.4 mm (0.25 in.) Valve member 40, having a head with a flange O.D. of 9.5 mm (0.38 in.), is made of a rigid material such as polycarbonate, nylon, polypropylene, etc.

A temperature sensitive element 38 is contained within chamber 118. A temperature sensitive element exhibits a repeatable response function as a result of applied temperature. In this embodiment, element 38 is a bimetallic strip formed into a coil with a strip width 9.5 mm (0.375 in.), a strip thickness 0.5 mm (0.020 in.) and a formed outer coil diameter 25 mm (1 in.). The radial outer end of element 38 forms a linkage 124. The inner end of element 38 attaches rigidly to a cylindrical shaft 52. The distance from the center axis of shaft 52 to the center axis of linkage 124 is 16.5 mm (0.65 in.). The lower end of shaft 52 is located within a blind bore 126 of lower housing 44 and is allowed to rotate freely. The upper end of shaft 52 extends through a bore 128 in upper housing 42 passing into a bore 130 of temperature selector 34. Shaft 52 is locked rigidly to selector 34 with a set screw 58. Shaft 52 is constructed of corrosion resistant metal such as brass, stainless steel or aluminum with a diameter of 6.4 mm (0.25 in.). The mid portion of shaft 52 is slightly larger in diameter, creating an upper shoulder 132 and a lower shoulder 134. A stainless steel flat washer 50 is oriented such that its lower face mates against shoulder 132 of shaft 52, while the upper washer face mates against upper housing 42. This arrangement allows rotation of shaft 52 relative to upper housing 42 but prevents axial movement. A seal 46 prevents fluid leakage between shaft 52 and upper housing 42. A gasket 48 prevents fluid leakage between lower housing 44 and upper housing 42.

Figure 9:
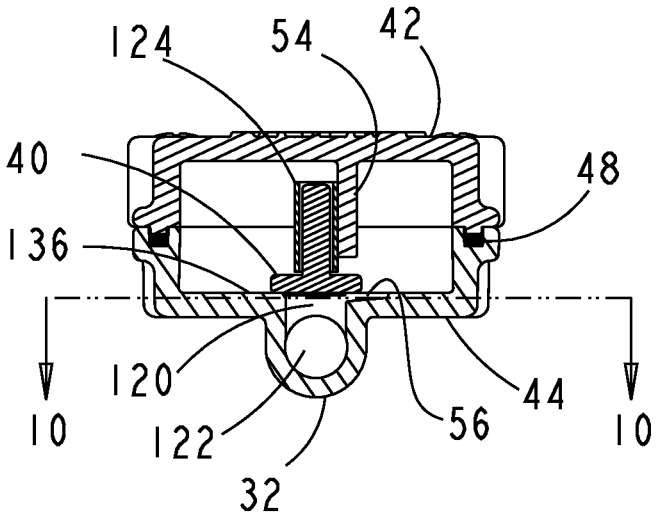
FIG. 9 is a section view of a temperature-responsive valve taken along line 9-9 in FIG. 5.
Figure 10:
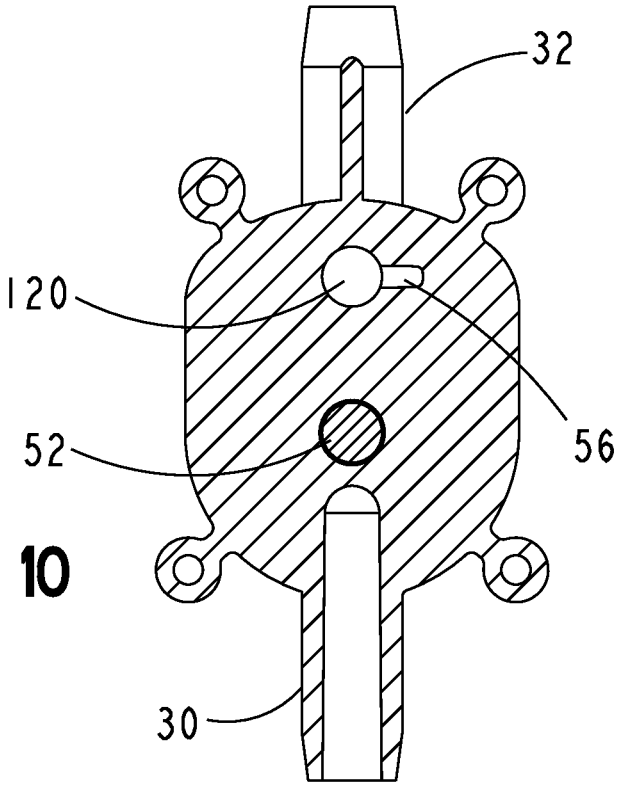
FIG. 10 is a section view of a temperature-responsive valve taken along line 10-10 in FIG. 9.

Referring to FIGS. 9 and 10, valve member 40 is shown in a closed position centered over aperture 120. A stop 54 restricts clockwise rotation (viewed from top) of valve member 40 about shaft 52 any further than the center of aperture 120. Stop 54 is attached rigidly to upper housing 42. This present closed or zero-displacement position of valve member 40 provides a maximum degree of flow restriction. A fixed orifice 56, a three-sided furrow formed into surface 136, intersects with aperture 120. Orifice 56 serves as a constant leak path which allows a minimum flow of water through temperature-responsive valve 22. In addition, orifice 56, having only 3 sides is advantageously self-cleaning minimizing the risk of becoming clogged with debris. Orifice 56 has a cross section of approximately 2.3 $mm^2$ (0.0035 $in^2$) in this embodiment.

Figure 11:
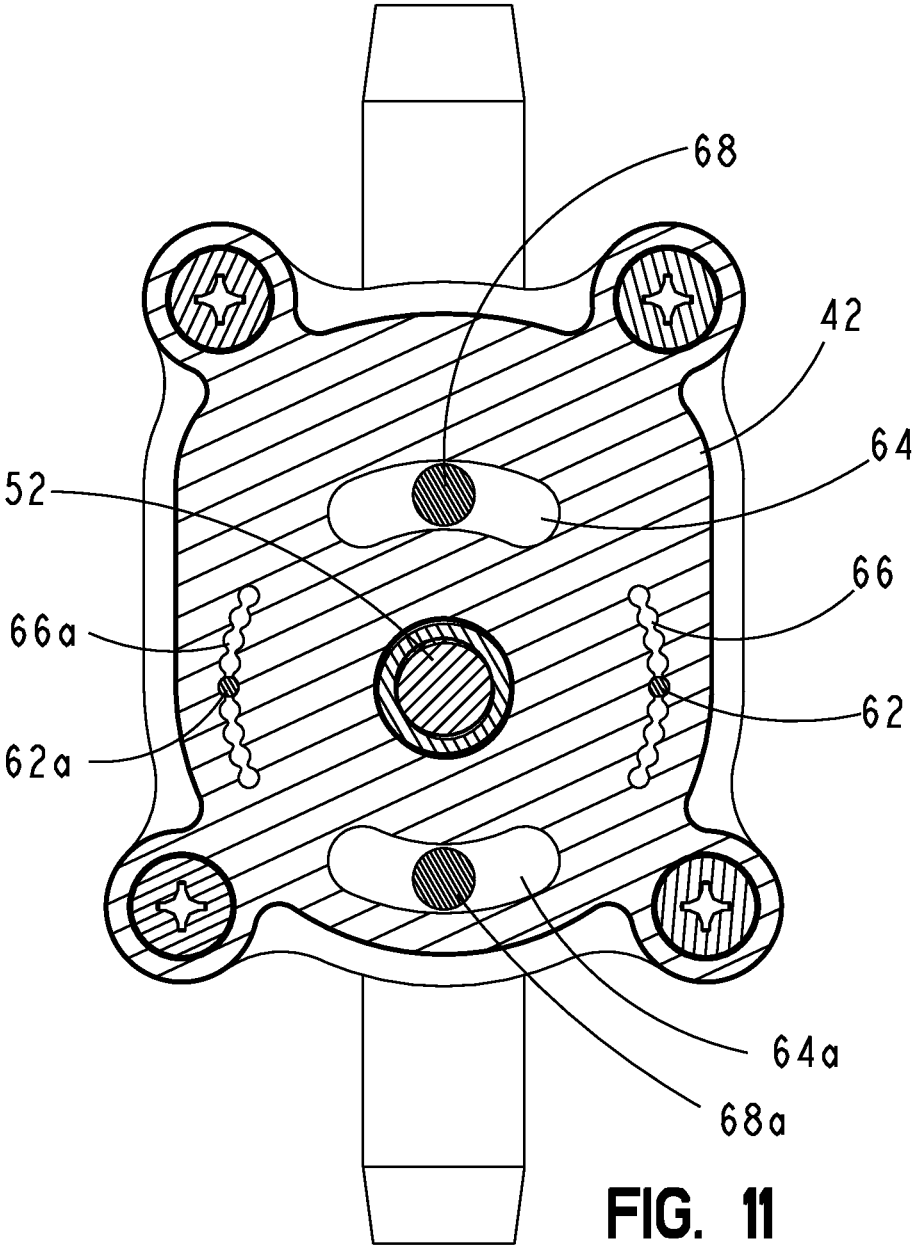
FIG. 11 is a section view of a temperature-responsive valve taken along line 11-11 in FIG. 6.

Referring to FIGS. 8, 9 and 11, temperature selector 34, made of a rigid material such as polycarbonate, nylon, polypropylene, etc., has two cylindrical protrusions 68 and **68*a* which are captivated within two slots 64 and 64*a*. Slots 64 and 64*a* are formed channels within upper housing 42. Shaft 52, locked to selector 34, is allowed to rotate within bores 126 and 128. Slots 64 and 64*a* provides positive stops to limit rotation of selector 34. In this embodiment, selector 34 is allowed to rotate plus or minus 25 angular degrees from the center position. On the underside of selector 34 are formed two hemispherical detents 62 and 62*a*. Two mating detent receptacle troughs 66 and 66*a* allow for a plurality of discrete resting positions of detents 62 and 62*a***. In this embodiment there are nine discrete positions representing nine different temperature settings.

It is suitable to produce the temperature-responsive valve with a different number of temperature settings by adding or removing detent positions or changing the spacing. It is also suitable to remove the adjustable temperature feature altogether and have a fixed temperature setting.

Figure 12:
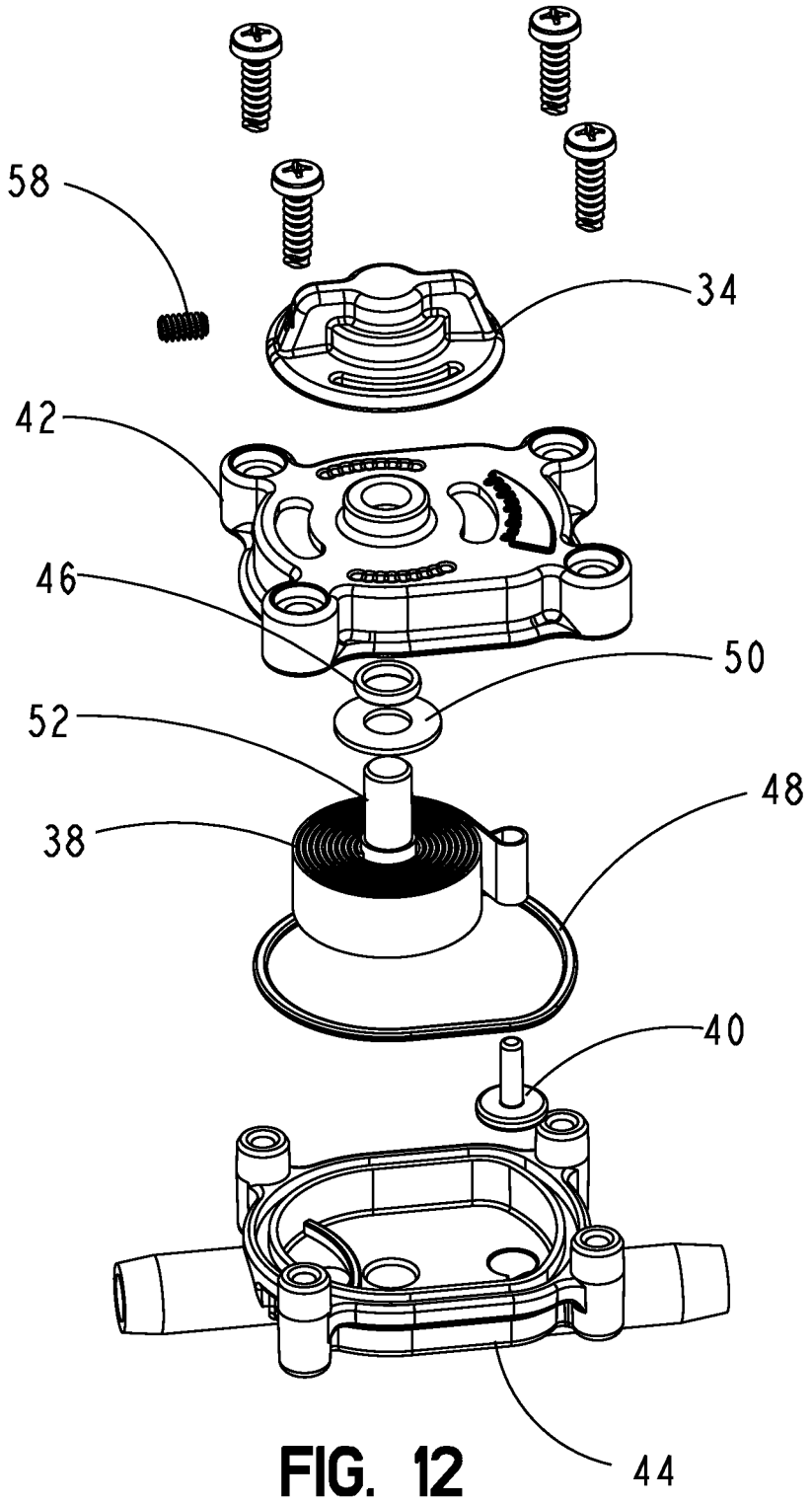
FIG. 12 is an exploded perspective view of a temperature-responsive valve shown in accordance with at least one embodiment.

FIG. 12 shows an exploded perspective view of temperature-responsive valve 22. This view provides additional clarity of components contained in temperature-responsive valve 22 in this embodiment.

Operation

General—First Embodiment

Referring to FIG. 1, the use of this portable temperature-controlled water heater requires a source of water, a heat source 28, and finally, a means of supporting elevated supply container 100. Possible methods for suspending container 100 may include a natural or man-made structure near the heat source such as a tree limb, rock etc. If no structure is conveniently located near heat source 28, a field constructed or prefabricated tripod may be used as another option of supporting supply container 100.

In preparation for heating a batch of water, supply container 100 is detached from duct 106, filled with water, and set aside. Drain port 104 is temporarily capped off to prevent loss of water. Heat source 28 is ignited and allowed to develop in intensity. Filled supply container 100 is suspended so that drain port 104 is at a height of 0.81-1.01 m (32-40 in.) higher than accumulating container 26 and horizontally approximately 0.9 m (3 ft) from heat source 28. This elevation differential between supply container 100 and accumulating container 26 produces a column of water pressure suitable for motivating a flow of water through the system during operation.

Referring to FIGS. 1 and 5, temperature-responsive valve outlet 32 is then connected to port 24 of accumulating container 26 and temperature selector 34 is set to a desired water temperature setting. Supply duct 106 is then connected to drain port 104 following removal of the temporary cap or plug blocking drain port 104. Water begins to flow through duct 106, heat exchanger 102, duct 20, temperature-responsive valve 22, and finally into container 26. After a couple seconds any air will have purged through the system. After flow of water has begun, heat is applied to heat exchanger 102 by placing on heat source 28. The water heating system is now in operation and after 10-15 minutes the process will deplete supply container 100 having transferred its contents to accumulating container 26. Factors that influence the amount of time required to heat the water include: the volume of water, the initial cold water temperature, the intensity of heat source 28, and the water temperature set by the user on temperature-responsive valve 22. Before supply container 100 is completely depleted of water, heat exchanger 102 must be removed from heat source 28 to avoid boiling stagnated water within heat exchanger 102 which would undesirably force steam out of the system through ducts 106 and 20. When heating is complete, temperature-responsive valve outlet 32 is disconnected from port 24 of container 26. Port 24 may be temporarily capped off. The user now possesses a quantity of warm water within container 26 that is at the desired temperature reflective of the temperature setting chosen. The user may then position the container at a place of their choosing to provide hot water for a shower or other cleanup function.

Temperature-Responsive Valve—First Embodiment

Referring to FIG. 1, temperature-responsive valve 22 automatically adjusts the flow rate of water during operation in order to produce an accurate temperature of water within accumulating container 26. In order to function properly, temperature-responsive valve 22 requires a minimum flow-through to ensure thermal feedback is provided to element 38. This minimum flow rate is determined primarily by the cross sectional opening of fixed orifice 56 and the height of supply container 100. When fully closed, valve 22 allows a minimum flow of approximately 20 fluid ounces/minute (0.6 liters/minute).

Heat is absorbed from heat source 28 into heat exchanger 102 and transferred to the minimum flow of water within, thus raising the temperature of water exiting heat exchanger 102. Referring to FIGS. 7 and 9, as the temperature of water flowing through temperature-responsive valve 22 rises to within approximately 3 C (5° F.) below the temperature setting, temperature sensitive element 38 begins to cause valve member 40 to move counter-clockwise about shaft 52 away from stop 54. As valve member 40 moves away from stop 54, aperture 120 is gradually uncovered, thus decreasing restriction and increasing the flow rate of water. As the flow rate increases, the dwell time of the water flowing through heat exchanger 102 is shortened and so the temperature of the water flowing begins to fall again. As the water temperature falls, temperature-responsive valve 22 conversely causes an increase in restriction and thus a decrease in flow as valve member 40 is moved toward stop 54.

Figure 17:
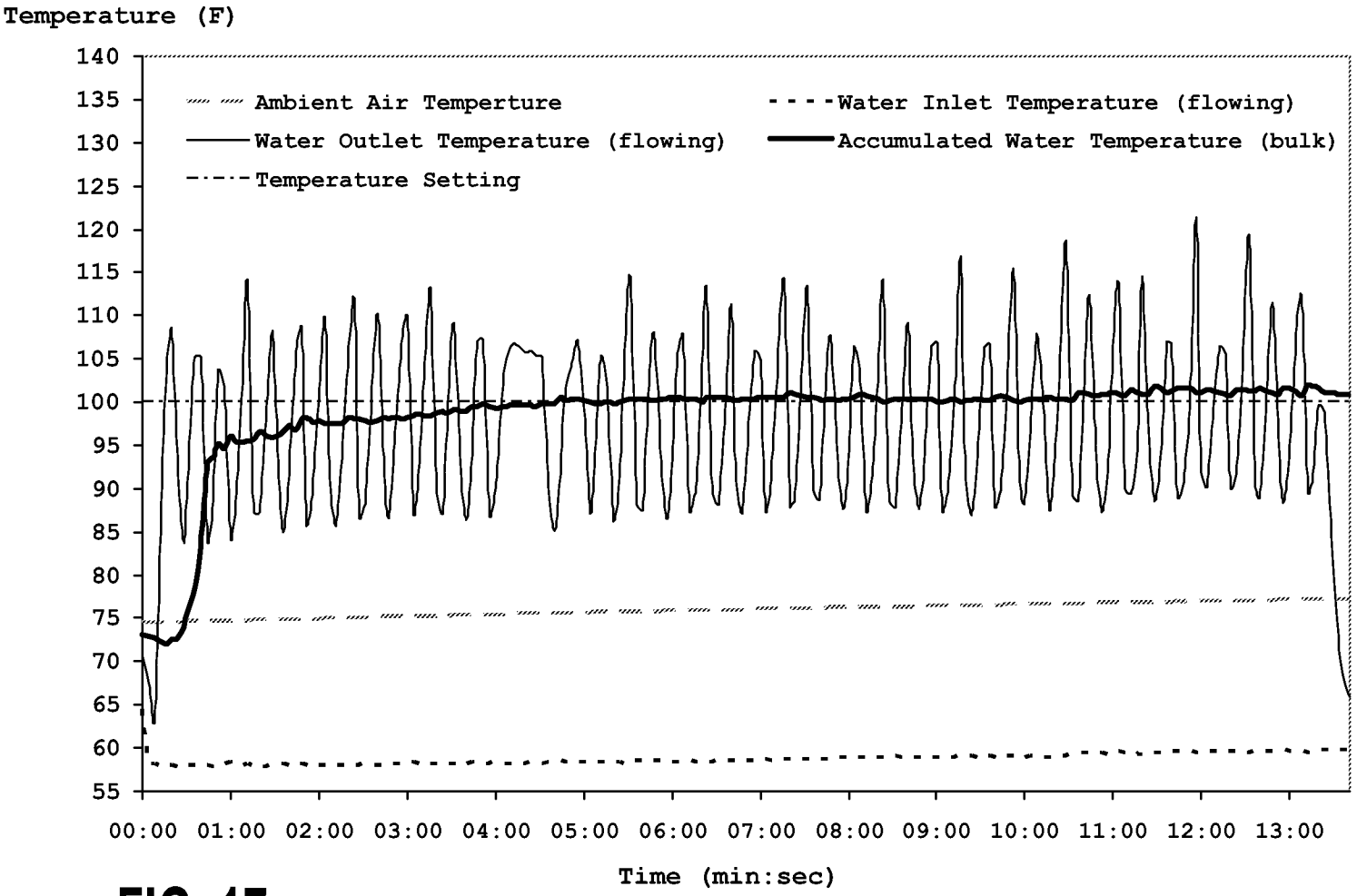
FIG. 17 is a chart showing typical operating temperatures of a portable water heater in accordance with at least one embodiment.

Element 38 exhibits a response function such that an increase in temperature produces a counter-clockwise rotation of linkage 124 about the center axis of shaft 52 at an approximate change of 1.25 angular degrees for every 0.55 C (1° F.). As the water temperature in contact with element 38 climbs approximately 3 C (5° F.) above the temperature setting, temperature-responsive valve 22 gradually displaces valve member 40 to a fully opened state allowing the maximum flow rate through the system of approximately 1.9 liters/min (64 fluid ounces/minute). Again, as the water temperature drops to a level of 3 C (5° F.) below the temperature setting, element 38 displaces valve member 40 clockwise, to a fully closed state producing the minimum flow rate mentioned above. Likewise, when the water temperature in contact with element 38 is approximately equal to the temperature setting, valve member 40 is displaced to cause a 50% flow restriction flowing approximately 42 fluid ounces/minute (1.2 liters/minute). Referring to FIG. 17, this thermal oscillation repeats many times during the 10-15 minutes of operation. Though the instantaneous temperature of water flowing through the system may vary as much as 15 C (28° F.), the bulk water temperature collected in accumulating container 26 is generally within 1.5 C (3° F.) of the temperature setting chosen by the user.

Figure 16A:
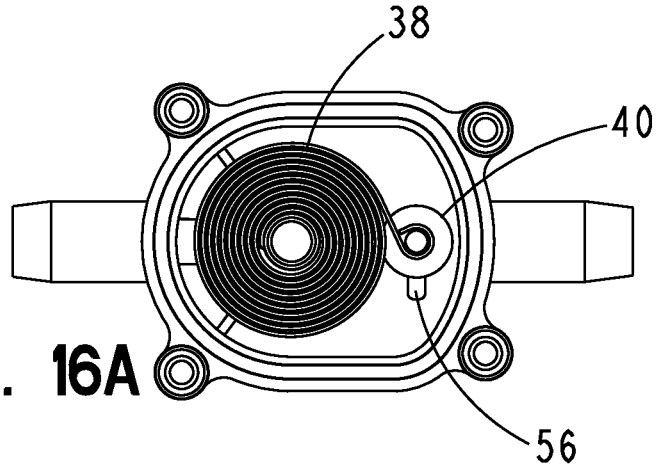
FIGS. 16A-16C are top views of three exemplary displacements of a temperature-responsive valve in accordance with at least one embodiment.
Figure 16B:
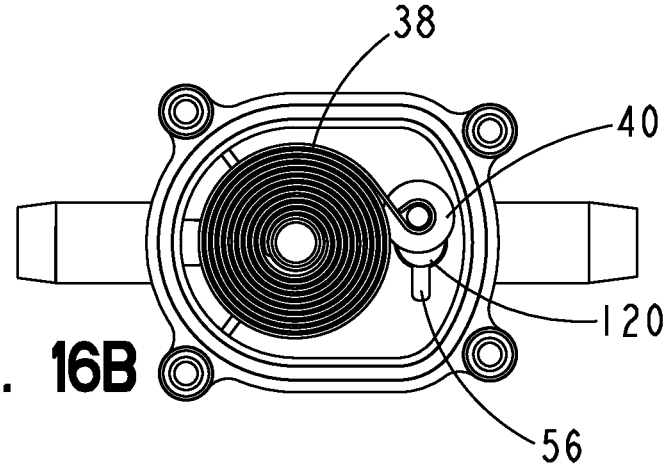
Figure 16C:
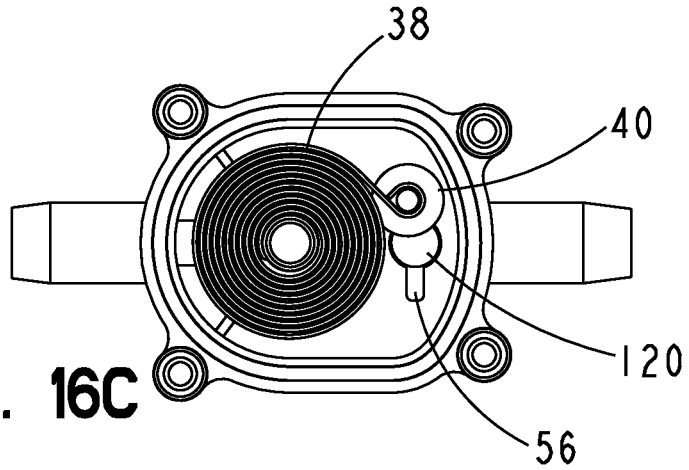

Referring to FIGS. 16A-16C, three displacements of valve member 40 are illustrated. Each displacement is a function of the water temperature in contact with element 38. FIG. 16A shows element 38 at a temperature several degrees or more below the chosen temperature setting. Valve member 40 is fully closed with the exception of the minimum flow rate allowed by fixed orifice 56. FIG. 16B shows valve member 40 at a displacement creating an approximately 50% flow restriction created by an opening of approximately 9.5 $mm^2$ (0.015 $in^2$). This displacement corresponds with a water temperature of approximately equal to the temperature setting. FIG. 16C shows the temperature-responsive valve approximately fully open and corresponds with a water temperature several degrees above the chosen temperature setting.

Referring to FIGS. 7 and 11, the water heating system is generally able to control the water temperature within a range of 27 C (80° F.) to 49 C (120° F.) and is determined by the position of selector 34, set by the user. In this embodiment, when selector 34 is set to the center or middle position, the corresponding control temperature is 37 C (100° F.). Adjusting selector 34 to the next detent position increases or decreases the temperature setting by 2.8 C (5° F.) depending on the direction of rotation. Clockwise rotation of selector 34 produces an increase in temperature setting; counter-clockwise rotation produces a decrease in temperature setting. In this embodiment the detent spacing is 6.25 angular degrees with a total of 9 discrete positions again ranging from 27 C (80° F.) to 49 C (120° F.).

In this embodiment, the heating system is sized for a broad range of initial water temperatures of 4 C (40° F.) to 27 C (80° F.) and net absorbed heating intensities of 3000 BTUH to 10,000 BTUH. When using low heat intensities (3000 BTUH absorbed), the maximum increase in water temperature that can be expected is approximately +22 C (+40° F.). Conversely, very high heat intensities (10,000 BTUH absorbed) should be reserved for use when the supply water is below 15 C (60° F.). These limits are dictated by the elevation of supply container 100 and the effective diameters and lengths of the components. The operating range limits could be varied by changing one or more of these parameters, however presently I contemplate that the current sizing provides a practical operating range.

In this embodiment, the upper temperature setting limit of 49 C (120° F.) could be changed by adjusting the length of slots 64 and 64*a* in FIG. 7 and adding or removing detent positions, however presently I contemplate that an upper limit of 49 C (120° F.) provides a practical upper temperature setting limit. In addition, it should be noted that it is advantageous to leave a reasonable margin of temperature between the upper temperature setting limit and the boiling point of water. If, during operation, the flowing water should reach the boiling point within heat exchanger 102 (FIG. 1) the steam generated would disrupt the flow of water and undesirably force water and steam out of ducts 106 and 20. An upper temperature setting limit of 49 C (120° F.) provides an adequate margin to avoid this behavior.

Calibration of Temperature-Responsive Valve

Referring to FIGS. 7 and 9, a one-time initial calibration of temperature-responsive valve 22 is performed with lower housing 44 removed. Temperature selector 34 is set to a predetermined calibration position, for example the center position representing 38 C (100° F.). Set screw 58 is loosened. The partial assembly is placed in a bath of water controlled to 38 C (100° F.). Shaft 52 is then adjusted within bore 130 of selector 34 (still in the center temperature position) such that a gap of 3 mm (0.12 in.) is present between linkage 124 and stop 54. Temperature selector 34 is locked to shaft 52 by tightening set screw 58 and lower housing 44 is assembled to upper housing 42 thus completing initial calibration.

Duct Insulator—First Embodiment

Referring to FIGS. 2-4, flexible duct insulator 108 allows flexibility at the same time providing thermal protection of ducts 106 and 20. Duct insulator 108 allows this encompassed length of ducts 106 and 20 to be in direct contact with flames produced by heat source 28 (FIG. 1). Insulation sleeve 72 provides a means for maintaining a large temperature gradient between the outer surface of sheath 70 and the O.D. of ducts 106 and 20. This temperature gradient is required to prevent damage of ducts 106 and 20 due to excessive temperature. Heat migration inward toward ducts 106 and 20 is slowed by insulation sleeve 72. Heat that reaches ducts 106 and 20 is effectively absorbed into the flowing water within.

Water is required to be flowing at all times through ducts 106 and 20 to prevent thermal damage.

Storage—First Embodiment

In this embodiment, flexible duct insulator 108 along with ducts 106 and 20 may be coiled within the concave portion of heat exchanger 102 during storage and transportation, resulting in a relatively compact size of approximately 180 mm (7 in.) in diameter×50 mm (2 in.) height.

Figure 13:
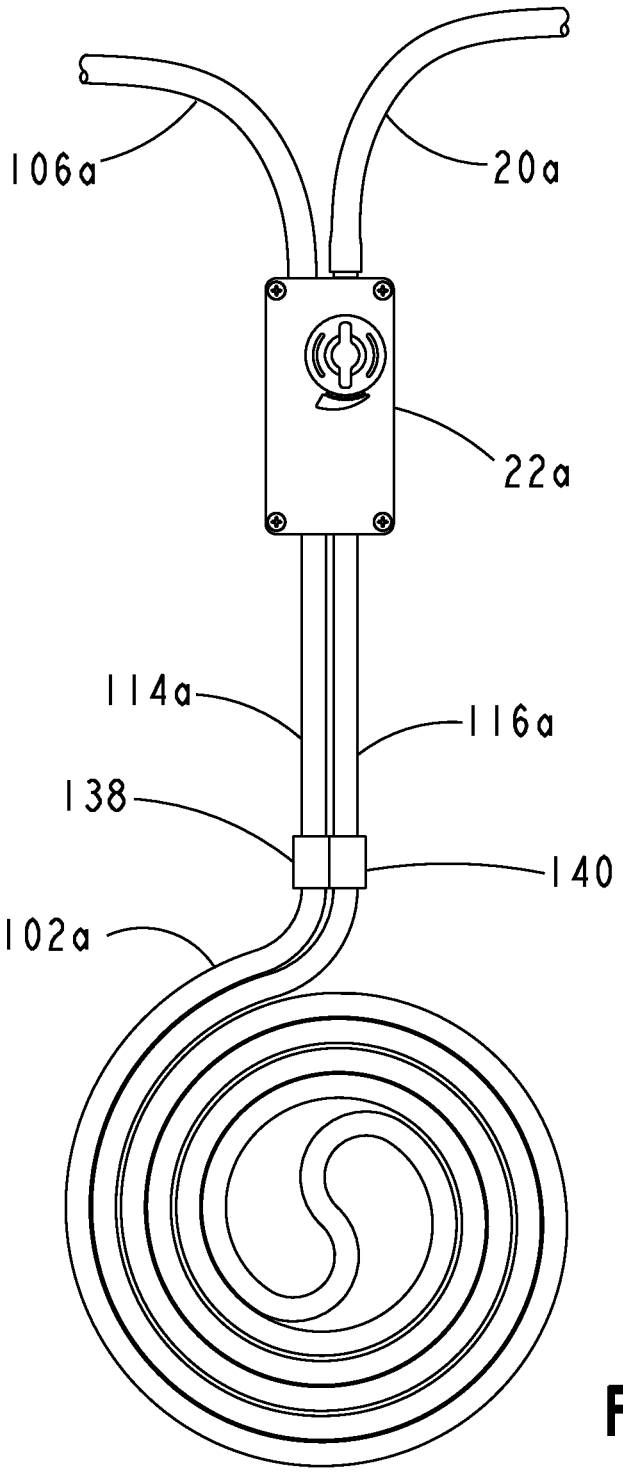
FIG. 13 is a top view of a heat exchanger shown in accordance with an alternate embodiment.

Second Embodiment—FIG. 13

A combination temperature-responsive valve and handle assembly 22*a* is located at the ends of a heat exchanger inlet extension 114*a* and a heat exchanger outlet extension 116*a*. Inlet and outlet extensions 114*a* and 116*a* are made of similar metallic tubing as a heat exchanger 102*a* and are approximately 250 mm (10 in.) to 380 mm (15 in.) in length. A supply duct 106*a* connects to inlet extension 114*a* within assembly 22*a*. Outlet extension 116*a* connects to assembly 22*a* which functions similarly to temperature-responsive valve 22 described in the first embodiment. An optional pair of brass, aluminum, stainless steel, etc. detachment couplings 138 and 140 provides a disconnecting point and allows for a more compact overall storage size. Suitable coupling types for couplings 138 and 140 are compression, flared, telescoping, etc.

Figure 14:
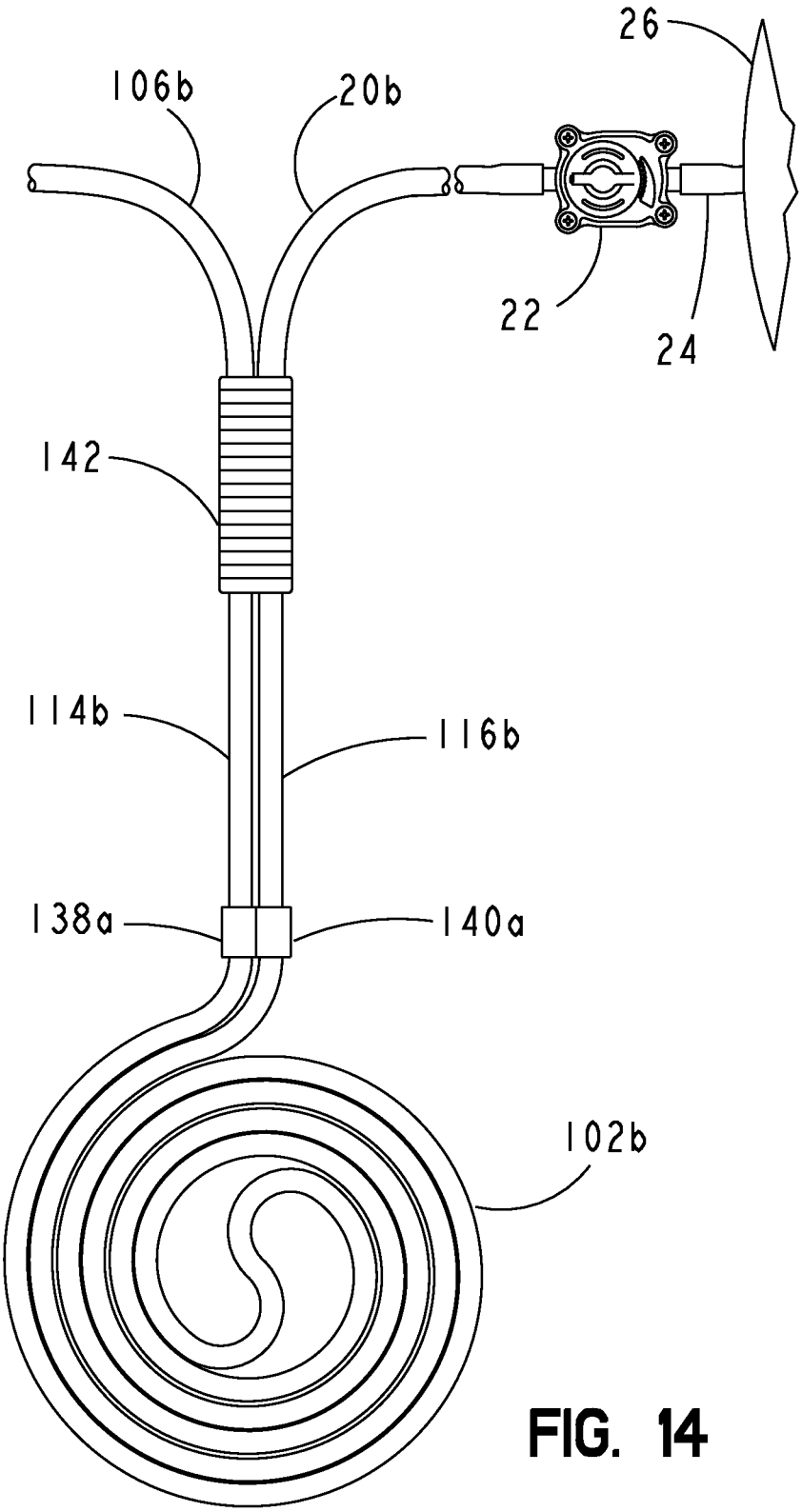
FIG. 14 is a top view of a heat exchanger shown in accordance with an alternate embodiment.

Third Embodiment—FIG. 14

A supply duct 106*b* connects to a heat exchanger inlet extension 114*b*. A heated water duct 20*b* connects to a heat exchanger outlet extension 116*b*. An insulating non-metallic handle 142 is attached to the ends of extensions 114*b* and 116*b*. An optional pair of brass, aluminum, stainless steel, etc. detachment couplings 138*a* and 140*a* provides a disconnecting point and allows for a more compact overall storage size.

Figure 15A:
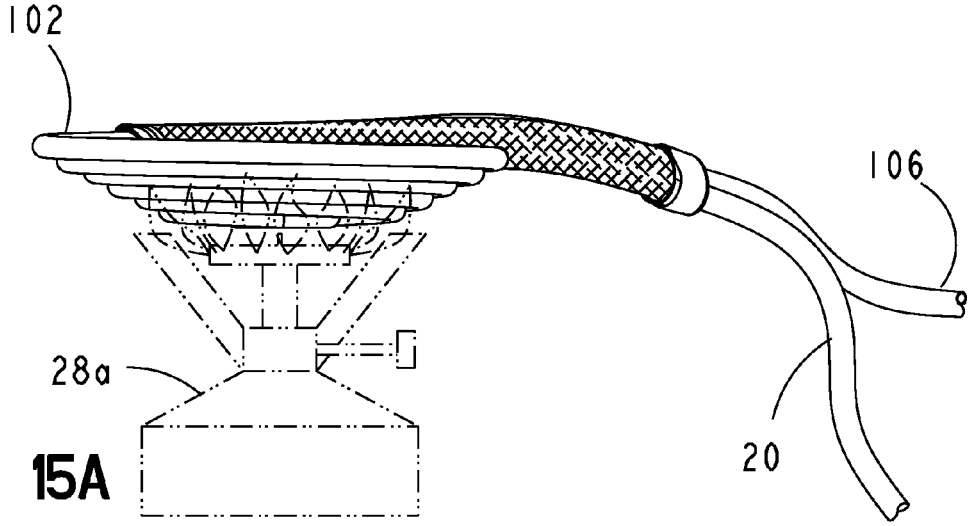
FIG. 15A is a front elevation view of a heat exchanger and heat source shown in accordance with an alternate embodiment.
Figure 15B:
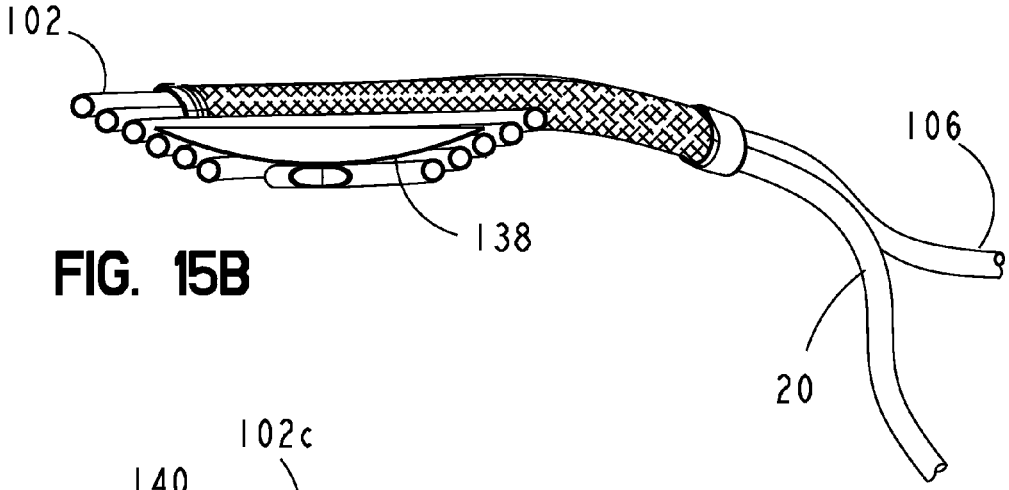
FIG. 15B is a section view of a heat exchanger shown in accordance with an alternate embodiment.
Figure 15C:
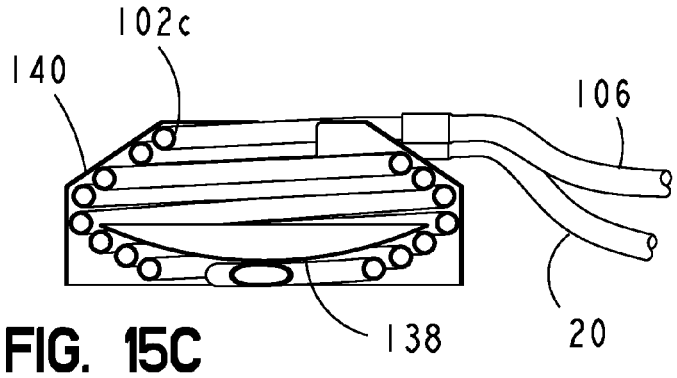
FIG. 15C is a section view of a heat exchanger shown in accordance with an alternate embodiment.

Additional Embodiments—FIGS. 15A-15C

Heat exchanger 102 is shown in combination with a heat source 28*a* in FIG. 15A. In the embodiment shown, heat source 28*a* is a conventional liquid fueled burner of which may consume one of many liquid fuels such as propane, butane, petroleum, naphtha, etc. A typical fuel burn rate of 7,500-15,000 BTUH provides a suitable heating rate for the shown embodiment. The general operation is much the same as with the previous embodiments, however a higher heating efficiency may be obtained by placing heat exchanger 102 in a concave-up position as shown in FIGS. 15A and 15B. In addition, an optional heat deflector 138 (FIG. 15B), may be used to further improve heating efficiency by directing the hot exhaust gases outward, maximizing the contact with heat exchanger 102. Deflector 138 is approximately 125 mm (5 inches) in diameter and constructed of a heat resistant material such as stainless steel.

A heat exchanger 102*c* (FIG. 16C) in an alternate configuration is shown with heat deflector 138 and an outer enclosure 140 constructed of a heat resistant material such as aluminum, steel, fiberglass, etc. The use of enclosure 140 further improving efficiencies by channeling combustion gases around the surfaces of heat exchanger 102*c*. At this time I contemplate that it is preferred that heat exchanger 102*c* is constructed to allow removal from heat source 28*a* (FIG. 15A), however exchanger 102*c* could also be permanently joined to a dedicated burner assembly.

CONCLUSION, RAMIFICATIONS, AND SCOPE

Thus, the reader will see that a portable water heating system described through the various embodiments has several practical advantages for a wide range of users spending time in the outdoors. In at least one embodiment, the total weight of the system including containers is less than 0.9 kg (2 pounds) and packs to a size of 180 mm (7 in.) in diameter× 50 mm (2 in.) height. With few moving parts and a small total number of components, the cost to manufacture is relatively low compared to other water heating devices. When used properly, the water heating system is relatively fast and accurate and has the capability of heating hundreds of gallons of water without failure or need for batteries. Furthermore, the heating system provides exceptional versatility, adapting to multiple heat sources in at least one embodiment.

While my above description contains many specifics, these should not be construed as limitations on the scope of the invention, but rather as an exemplification of several preferred embodiments thereof. Many other variations are possible.

Alternate temperature-responsive valve constructions are possible. For example, an expanding wax pellet temperature sensitive element is suitable although generally slower responding which limits the allowable ranges of inlet temperatures and heat intensities applied to the system for proper operation. Alternately, an electro-mechanical temperature-responsive valve incorporating a temperature sensor, a microprocessor and a valve actuator provides exceptional control and programmability; however it is accompanied by additional manufacturing cost, increased physical size, and the inconvenient need for batteries in the field.

Individual dimensions of components and/or the overall scaling of the water heating system could be sized up or down for a trade-off in heating performance and overall package size.

Accordingly, the scope of the invention should be determined not by the embodiments illustrated, but by the appended claims and their legal equivalents.

I claim:

1. A portable water heater comprising:

a supply container, positioned at a first elevation, said supply container at least partially enclosing a volume of water, an accumulating container positioned at a second elevation lower than said first elevation thus causing a pressure head differential between said first elevation and said second elevation, a heat exchanger having an inlet and an outlet, said heat exchanger located near a field-supplied heat source, from which energy is absorbed and transferred to a flow of water therein, a temperature-responsive valve having an inlet, an outlet, a chamber being in fluid communication with said inlet of said temperature-responsive valve and said outlet of said temperature-responsive valve, a primary aperture formed within a surface of said chamber, a secondary aperture intersecting said primary aperture along one side, a movable valve member having a displacement relative to said primary aperture causing a variable flow restriction, a stop for preventing said movable valve member from blocking said secondary aperture thereby causing a maximum flow restriction, a temperature-sensitive element positioned within said chamber and having a predetermined response function as a result of applied temperature, and a linkage for controllably coupling said response function of said temperature-sensitive element to said displacement of said moveable valve member, said temperature-responsive valve configured to have a predetermined temperature setting and causing a minimum flow restriction when the temperature of said flow of water is a predetermined margin greater than said temperature setting and said maximum flow restriction when the temperature of said flow of water is a predetermined margin less than said temperature setting, a first duct for fluidly coupling said supply container to said inlet of said heat exchanger, and a second duct for fluidly coupling said outlet of said heat exchanger to said inlet of said temperature-responsive valve, whereby said flow of water, caused by said pressure head differential, is automatically varied within a predetermined range by said temperature-responsive valve so that said volume of water is transferred from said supply container to said accumulating container at a temperature equal to that of said temperature setting.

2. The portable water heater of claim 1 wherein said temperature-sensitive element is a bimetal coil.

3. The portable water heater of claim 1 wherein said temperature-responsive valve further comprising a temperature selector controllably coupled to said temperature-sensitive element for biasing said response function and varying said temperature setting.

4. The portable water heater of claim 1 wherein said first and second ducts comprising non-metallic flexible tubing.

5. The portable water heater of claim 1 wherein said heat exchanger includes one or more flexible duct insulators for thermally protecting said first and second ducts from said heat source.

6. The portable water heater of claim 1 further comprising a third duct for directing said flow of water from said outlet of said temperature-responsive valve into said accumulating container.

* * * * *